US005897252A

United States Patent [19]

Kanakubo

[11] Patent Number: 5,897,252

[45] Date of Patent: Apr. 27, 1999

[54] PERIPHERAL DEVICE CONTROL METHOD AND PRINTING APPARATUS

[75] Inventor: Yukio Kanakubo, Kasukabe, Japan

[73] Assignee: Canon Kabushiki Kaisha, Tokyo, Japan

[21] Appl. No.: 08/898,611

[22] Filed: Jul. 22, 1997

Related U.S. Application Data

[63] Continuation of application No. 08/611,434, Mar. 4, 1996, abandoned, which is a continuation of application No. 08/227,620, Apr. 14, 1994, abandoned.

[30] Foreign Application Priority Data

Apr. 28, 1993 [JP] Japan ..... 5-102932
May 25, 1993 [JP] Japan ..... 5-122506

[51] Int. Cl.[6] ..... B41J 5/30

[52] U.S. Cl. ..... 400/74; 400/54

[58] Field of Search ..... 400/54, 74, 83, 400/703; 364/707

[56] References Cited

U.S. PATENT DOCUMENTS 4,557,615 12/1985 Ueno ..... 400/54
5,133,610 7/1992 Sukigara ..... 400/54
5,203,636 4/1993 Nishikawa ..... 400/54
5,218,353 6/1993 Okumura ..... 400/74

FOREIGN PATENT DOCUMENTS 58-106622 6/1983 Japan ..... 400/54
1-190471 7/1989 Japan ..... 400/83
16075 1/1990 Japan ..... 400/54
81143 3/1990 Japan ..... 400/74
34658 2/1991 Japan ..... 400/74

*Primary Examiner*—Christopher A. Bennett
*Attorney, Agent, or Firm*—Fitzpatrick, Cella, Harper & Scinto

[57] ABSTRACT

A printing apparatus which shuts off the power supply to the apparatus, if a state in which the power supply to the apparatus is meaningless continues for a predetermined period, to prevent wasteful electricity consumption. When a LBP has an abnormality, an error processor detects the abnormality, executes a predetermined processing such as notification of the occurrence of error, and outputs error information to a power controller. The power controller determines whether or not the abnormal state has continued for a predetermined period. If the power controller determines the continuation of the abnormality for the predetermined period, it outputs a power-off instruction to a power. The power shuts off the power supply to the respective elements of the LBP.

14 Claims, 15 Drawing Sheets

PERIPHERAL DEVICE CONTROL METHOD AND PRINTING APPARATUS

This application is a continuation of application Ser. No. 08/611,434 filed Mar. 4. 1996, now abandoned, which is a continuation of 08/227,620 filed Apr. 14, 1994 now abandoned.

BACKGROUND OF THE INVENTION

Present invention relates to a control method for a peripheral device connected to an external device and a printing apparatus using the control method.

Printer is one of peripheral devices connected to an external device such as a host computer. In case of abnormal state (error) in the printer itself or its printing operation, the printer informs a user of the error using a display such as an LCD panel or an LED. However, the error state continues unless the user removes the error, while a large amount of electricity is being consumed.

Generally, the user manipulates a switch to turn on or off the power to the printer. Further, even when the printer does not execute printing, large amount of electricity is always consumed to maintain a warmed-up state of the device. For this reason, if the user forgets to turn off the power, the considerably large amount of wasted electricity is not negligible.

Further, even when the printer does not execute printing operation, the display (a backup light, a fluorescent display tube etc.) and an LED display current state as long as the power is ON.

Recently, a printer is often used in a network environment and it is located distant from a user. Because of such distance, the user is often unaware of an error occurred to the printer for a while. Some network notifies the user of the occurrence of error at the printer via a host computer. However, as the user does not always monitors the host computer, the error state may not be found for hours. In this case, electricity will be wasted until the user notices the error. This poses a problem from the viewpoint of saving energy.

Further, even when the external device (host computer) is not connected to the printer, or the power of the external device that the printer is connected to is off, i.e., in a case where there is no possibility of data transmission to the printer, electricity is wastefully consumed as long as the power of the printer is on. This also poses a problem from the viewpoint of saving energy. For example, in the network environment, in a case where the printer is placed away from the external device, it is likely that the user forgets to turn off the power to the printer after the user has turned off the power of the external device.

As described above, the conventional printer continues wasting electricity until the user turns off the power, in spite of a meaningless state, i.e., an error state is not found for hours, or the power of the host computer is off and the printer is not used for hours.

Further, even in a case where the printer does not execute printing for hours though the power is on, the display and the LED continue displaying the state of the printer. Thus, the electricity is wasted by the display or the LED.

It should be noted that the above-described problem of wasting electricity is not limited to the case of conventional printer. Other peripheral devices connected to a host computer have a similar problem.

SUMMARY OF THE INVENTION

The present invention has been made in consideration of the above situation, and has as its object to provide a control method for a peripheral device and a printing apparatus which enables saving of electricity.

Another object of the present invention is to provide a peripheral device control method and a printing apparatus which enables preventing wasteful electricity consumption.

According to the present invention, the foregoing objects are attained by providing a printing apparatus for inputting printing data from an external device and performing recording on a recording medium based on the printing data, comprising: detection means for detecting an abnormal state of the printing apparatus; determination means for determining that the abnormal state detected by the detection means has continued for a predetermined period; and shut-off means for shutting off power supply to the printing apparatus based on a determination result by the determination means.

Further, the foregoing objects are attained by providing a control method for a printing apparatus for performing processing based on input data from an external device, comprising: a detection step of detecting an abnormal state of the printing apparatus; a determination step of determining that the abnormal state detected in the detection step has continued for a predetermined period; and a shut-off step of shutting off power supply to the printing apparatus based on a determination result in the determination step.

In the above construction, if some abnormality occurs to the apparatus and the error state continues for a predetermined period, information on the abnormality is stored in a recording medium, and the power of the apparatus is shut off. Thus, wasteful electricity consumption can be prevented.

Another object of the present invention is to provide a peripheral device control method and a printing apparatus which attains saving electricity consumption by automatically shutting off the power supply to the device in accordance with a predetermined period of error state.

Further object of the present invention is to provide a peripheral device control method and a printing apparatus which enables displaying an abnormal state after automatic shut-off operation of power supply to the device and improves operability.

Further object of the present invention is to provide a peripheral device control method and a printing apparatus which resumes a recording state after automatic shut-off operation of power supply to the device and continues the recording executed when the power was shut off.

Further object of the present invention is to provide a peripheral device control method and a printing apparatus which automatically shuts off power supply to the device in accordance with a predetermined period of error state and saves electricity.

Further object of the present invention is to provide a peripheral device control method and printing apparatus which, when communication with an external device becomes possible after the power supply was shut off in accordance with a predetermined period of non-communication state with the external device, automatically restarts the power supply to the device, and improves operability.

Further object of the present invention is to provide a peripheral device control method and printing apparatus which controls a display state of the device to save electricity consumption in a case where data from an external device is not supplied to the device for a predetermined period.

According to the present invention, the foregoing objects are attained by providing a printing apparatus for performing recording based on input data from an external device, comprising: display means for displaying various states; determination means for determining that a state where the printing apparatus receives no input data from the external device has continued for a predetermined period; and control means for controlling a display of the display means, based on a determination result by the determination means, so as to save electricity consumption.

Further, the foregoing objects are attained by providing a control method for a printing apparatus for performing processing based on input data from an external device and displaying various states with a display unit, comprising: a determination step of determining that a state where the printing apparatus receives no input data from the external device has continued for a predetermined period; and a control step of controlling a display of the display unit, based on a determination result in the determination step, so as to save electricity consumption.

In the above constriction, it is determined that input data from the external device is not received for a predetermined period, and displaying of that state is controlled in accordance with the determination.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 16 is a perspective view of an ink-jet recording apparatus that the present invention is applied to;

DETAILED DESCRIPTION OF THE PREFERRED EMBODIMENTS

Preferred embodiments of the present invention will be described in detail in accordance with the accompanying drawings.

First Embodiment

[Laser-beam Printer (FIG. 1)]

First, a laser-beam printer that the present invention is applied to will be described with reference to FIG. 1.

Figure 1:
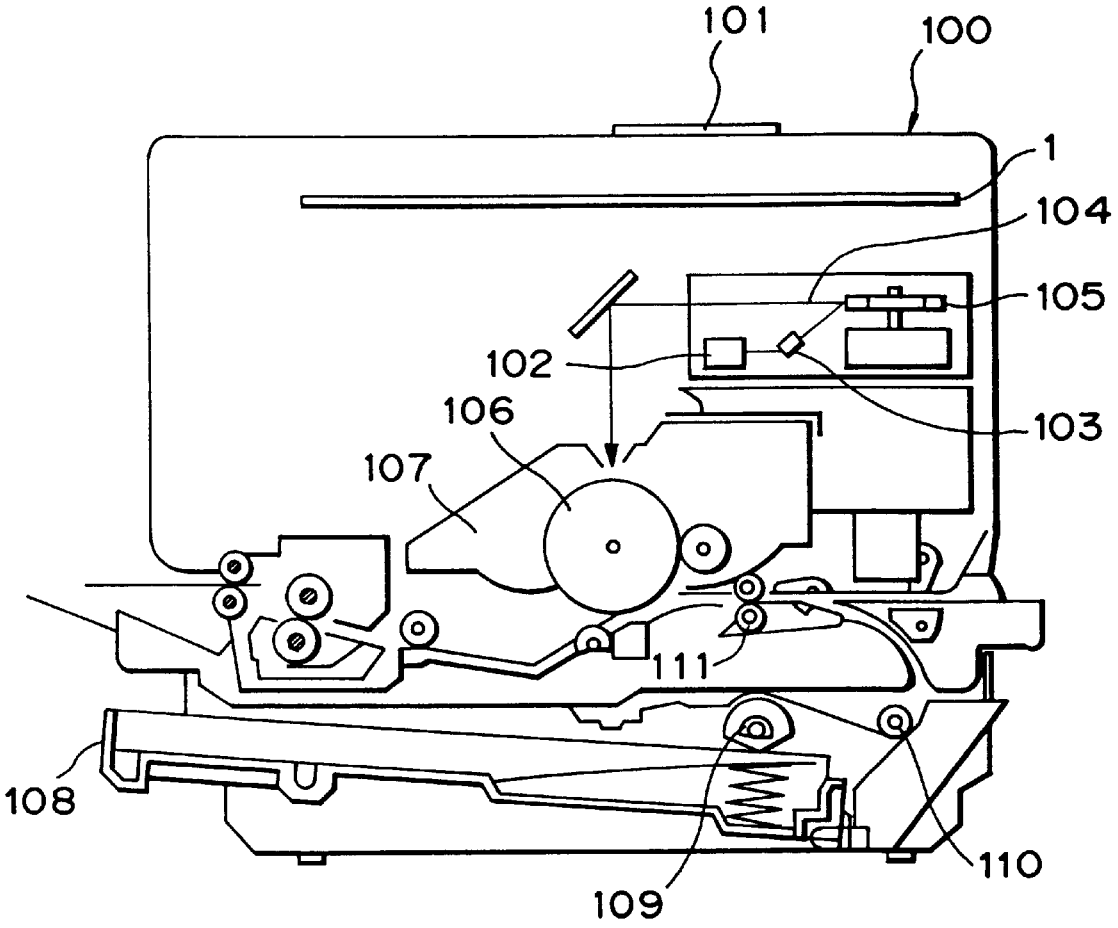
FIG. 1 is a cross-section of a laser-beam printer according to the embodiments of the present invention.

FIG. 1 shows the construction of a laser-beam printer (hereinafter, referred to as "LBP"). In FIG. 1, reference numeral 100 denotes a LBP main body which inputs character information (character code), form information, macroinstruction and the like supplied from an external device (to be described with reference to FIG. 2), and generates character patterns and form patterns corresponding to the input information, to form an image on a recording sheet as a recording medium; 101, an operation panel including operation switches, an LED, and a display; and 1, a controller which controls the overall apparatus, and analyzes information such as character information supplied from an external device. The controller 1 converts mainly character information into a video signal representing a corresponding character pattern, and outputs the signal to a laser driver 102.

The laser driver 102 drives a semiconductor laser 103. The laser driver 102 turns on or off a laser light 104 emitted from the semiconductor laser 103 in correspondence with the video signal inputted from the controller 1. A rotating polygon mirror 105 scans the laser light 104 on an electrostatic drum 106 in right-and-left directions. This forms electrostatic latent image of character pattern on the electrostatic drum 106. The latent image is developed by a developing unit 107 provided around the electrostatic drum 106 and transferred onto a recording sheet. The recording sheet is a cut-sheet set in a paper cassette 108 attached to the LBP 100. A paper feeding roller 109, and paper conveying rollers 110 and 111 convey the recording sheet to the electrostatic drum 106.

[Printer Control System (FIG. 2)]

Figure 2:
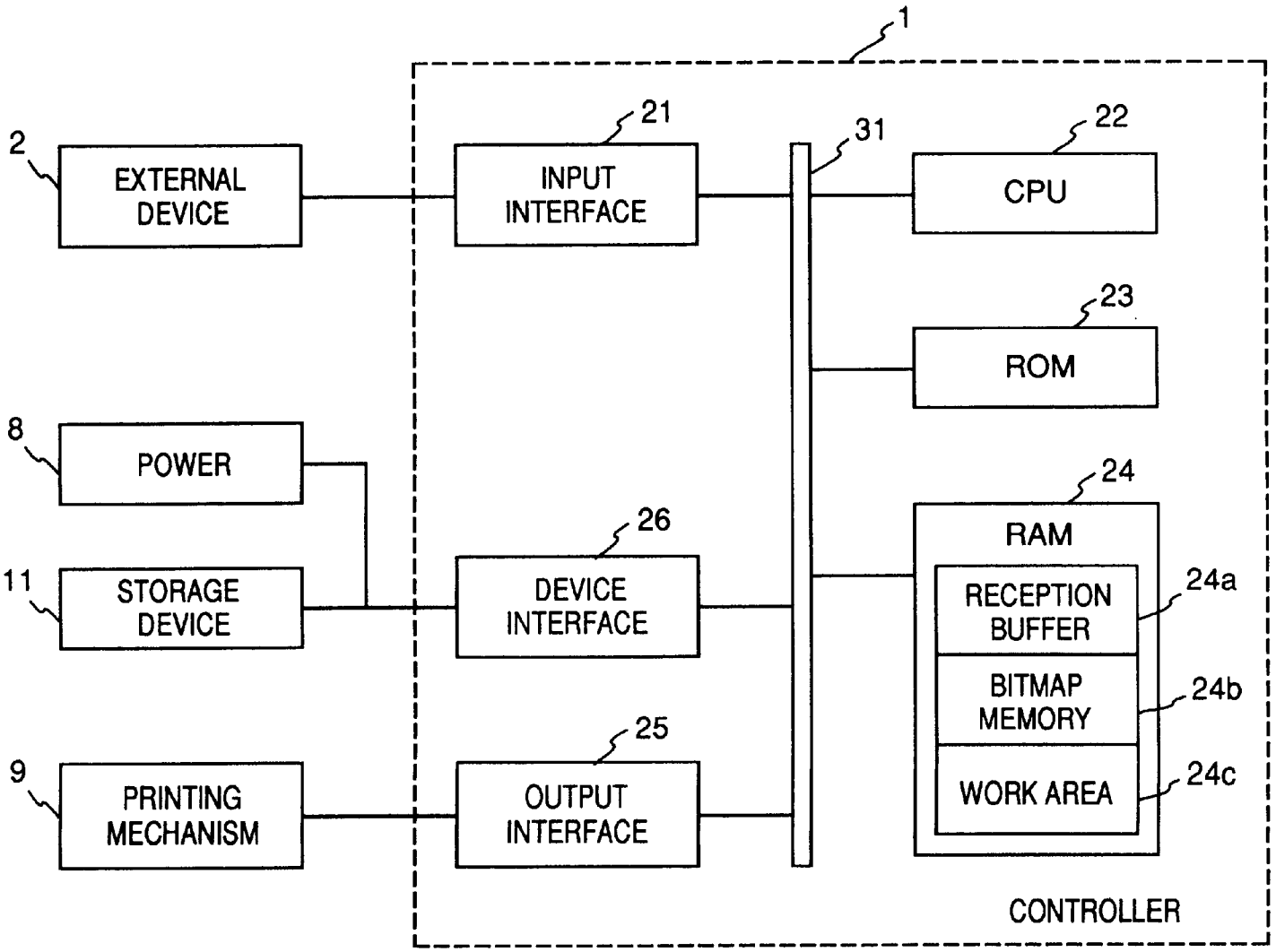
FIG. 2 is a block diagram showing the construction of a control system of the laser-beam printer in FIG. 1.

FIG. 2 shows the configuration of a control system in the laser-beam printer in FIG. 1. In FIG. 2, numeral 2 denotes an external device which transmits data such as printing data to the LBP 100; 8, a power which supplies electric power to respective elements of the LBP 100; 9, a printing mechanism which executes recording based on image data outputted from the controller 1 on the recording medium (recording sheet), using a laser-beam printing method; and 11, a storage device for storing information including error information to be described later. It should be noted that the storage device 11 comprises a non-volatile memory (e.g., a hard disk and a floppy disk).

Numeral 21 denotes an input interface which inputs various data from an external device 2; 22, a CPU which controls the overall controller 1; 23, a ROM in which various control programs for the CPU 22 and character font patterns are stored; 24, a RAM which includes a reception buffer 24*a* for storing printing data from the external device 2, a bitmap memory 24*b* for storing image data developed from the printing data, and a work area 24*c* for the CPU 22 to execute the control programs; 25, an output interface for outputting image data stored in the bitmap memory 24*b* to the printing mechanism 9; and 26, a device interface for data transmission between the power 8 or the storage device 11 and the CPU 22. The respective elements in the controller 1 are connected to a system bus 31 for mutual data transfer.

Figure 3:
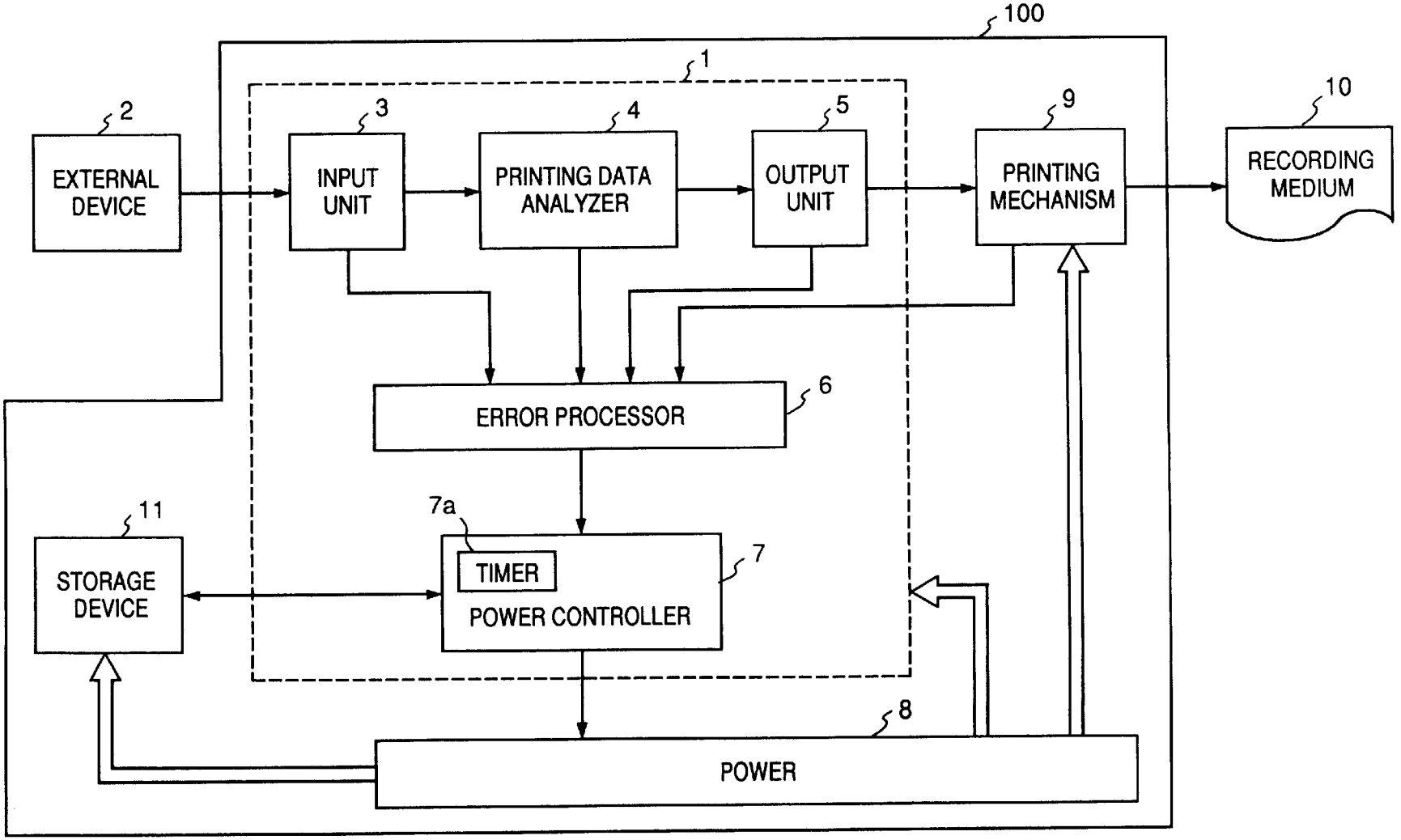
FIG. 3 is a block diagram showing the functional construction of a controller 1 according to a first embodiment of the present invention.

The processing by the controller 1 in the LBP 100 having the above construction will be described with reference to FIG. 3, which shows the functional construction of the controller 1.

First, the operation of the controller 1 in a case where the printer normally performs its printing processing will be described in accordance with the block diagram of FIG. 3. An input unit 3 receives, via the input interface 21, printing data outputted from the external device 2 which is a host computer and the like, and stores the data into the reception buffer 24*a*. Next, an printing data analyzer 4 analyzes the received data in the reception buffer 24*a* and generates bitmapped image data, then stores the data into the bitmap memory 24*b*. An output unit 5 outputs the image data, as a video signal for on/off control of the laser-beam, from the output interface 25 to the printing mechanism 9. The printing mechanism 9 performs printing on the recording medium such as a recording sheet, using the laser-beam printing method.

Next, the printing processing in a case where an abnormal state, i.e., an error occurs to the printing mechanism 9 or within the controller 1 will be described below.

The input unit 3, the printing data analyzer 4, the output unit 5 and the printing mechanism 9 respectively monitor whether or not an error has occurred during printing. If these elements detect an error, they inform an error processor 6 of the occurrence of error. An example of the errors detected within the controller 1 is a data transmission error. The errors detected in the printing mechanism 9 include an out-of-paper state, a paper jam state and a trouble of conveying motor. It should be noted that the states such as "out-of-paper" may always be monitored.

Figure 4:
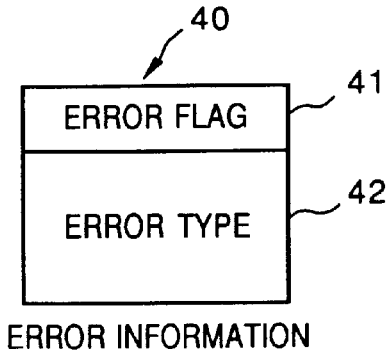
FIG. 4 illustrates data format of error information generated by an error processor according to the first embodiment.

The error processor 6 receives information of the occurrence of error, and executes processing against the error, further, generates error information and transfers the information to a power controller 7 (to be described with reference the flowchart in FIG. 5). FIG. 4 shows the data format of the error information generated by the error processor 6. In FIG. 4, an error information 40 comprises an error flag 41 indicating the occurrence of error and an error type 42 indicating the type of error. The power controller 7 receives the error information and starts measuring time using a timer 7*a*. If any error-removal operation is not made within a predetermined period, the power controller 7 stores the error information into the storage device 11, and controls the power 8 to shut off power supply (to be described with reference to the flowchart in FIG. 6) to the LBP 100.

Thereafter, if the power is turned on, the power controller 7 checks the error flag 41 of the error information 40 in the storage device 11. the CPU 22 switches start-up processings (to be described with reference to the flowchart in FIG. 7) in accordance with the state of the error flag 41.

The above operation will be described in detail with reference to the flowcharts in FIGS. 5 to 7.

Figure 5:
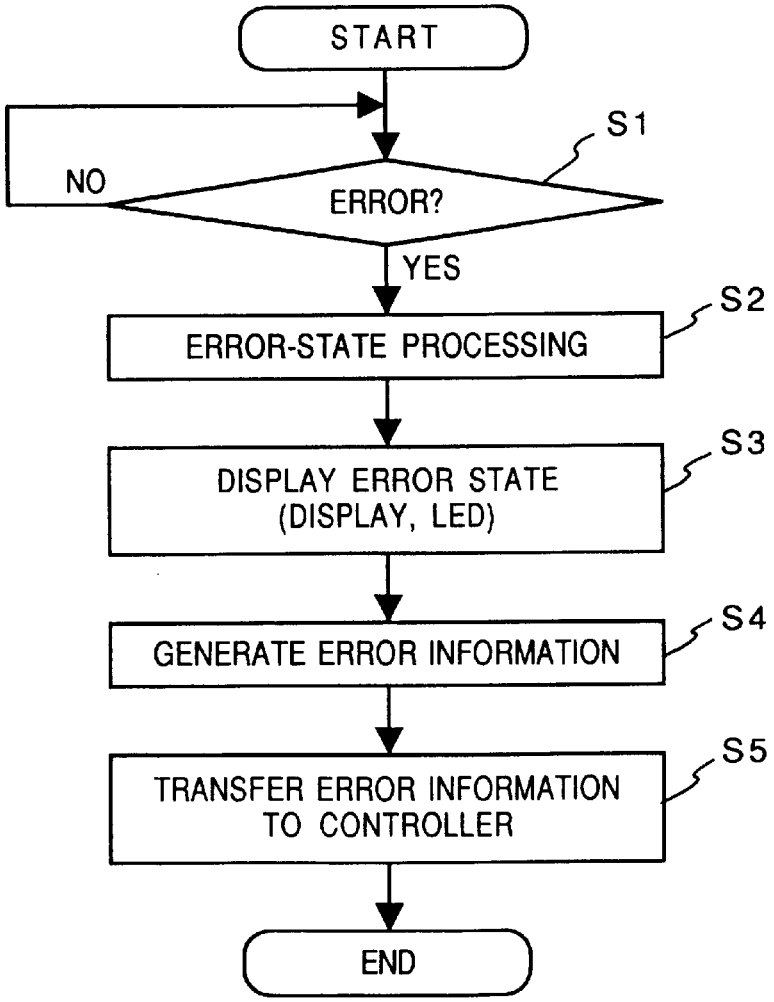
FIG. 5 is a flowchart showing processing by the error processor.

FIG. 5 shows the processing procedure by the error processor 6. In step S1, the error processor 6 monitors whether the input unit 3, the printing data analyzer 4, the output unit 5 and the printing mechanism 9 detect an error or not. If NO, step S1 is repeated. On the other hand, if YES, the process proceeds to step S2. In steps S2 and S3, error processing is performed. In step S2, as error-state processing, data input from the external device 2 is stopped, or if a recording sheet is being discharged, the discharging is completed. In step S3, the occurrence of error and its content are displayed by the display or the LED. In step S4, the error information 40 is generated, and in step S5, the error information 40 is transferred to the power controller 7.

Figure 6:
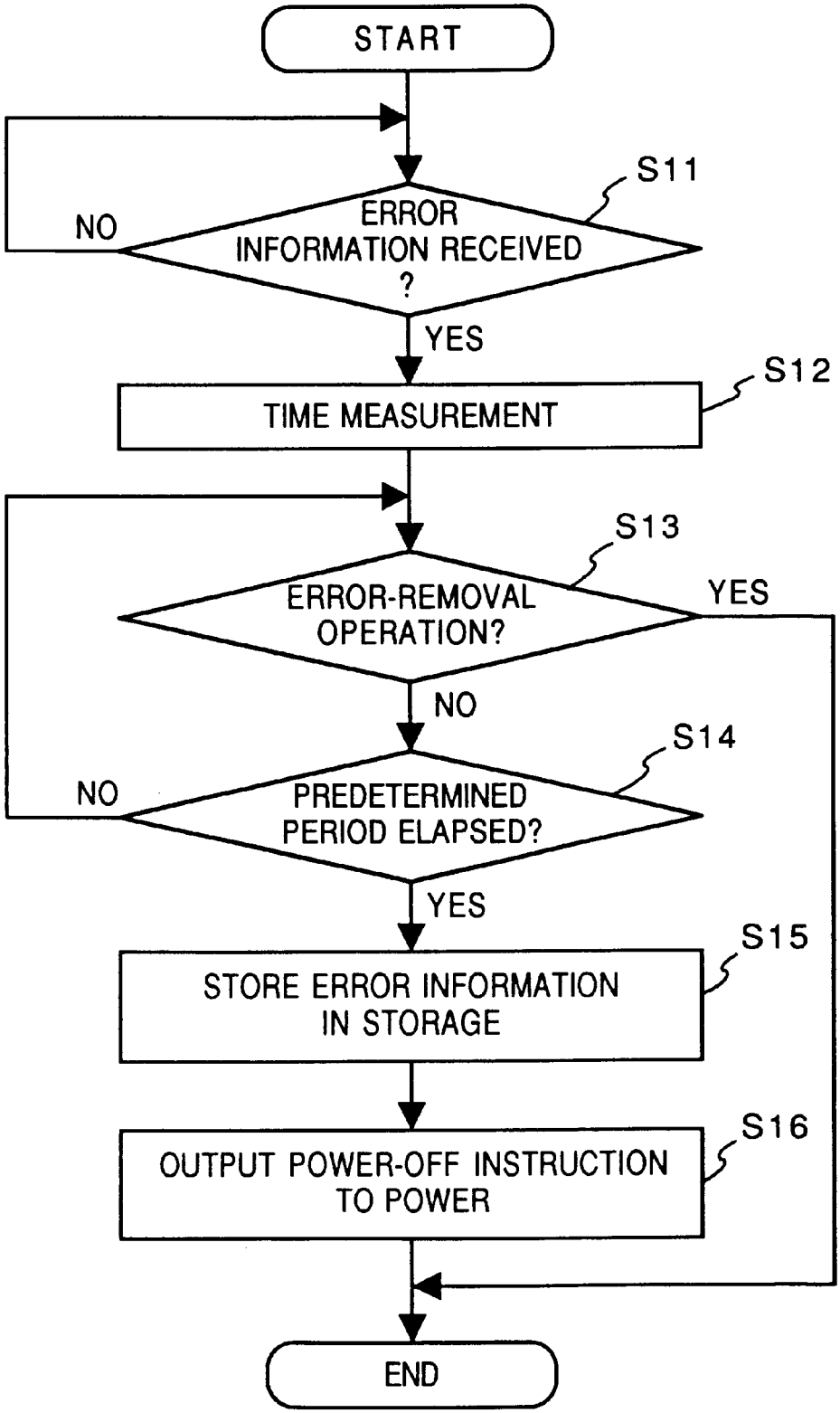
FIG. 6 is a flowchart showing operation by a power controller 7 according to the first embodiment.
Figure 7:
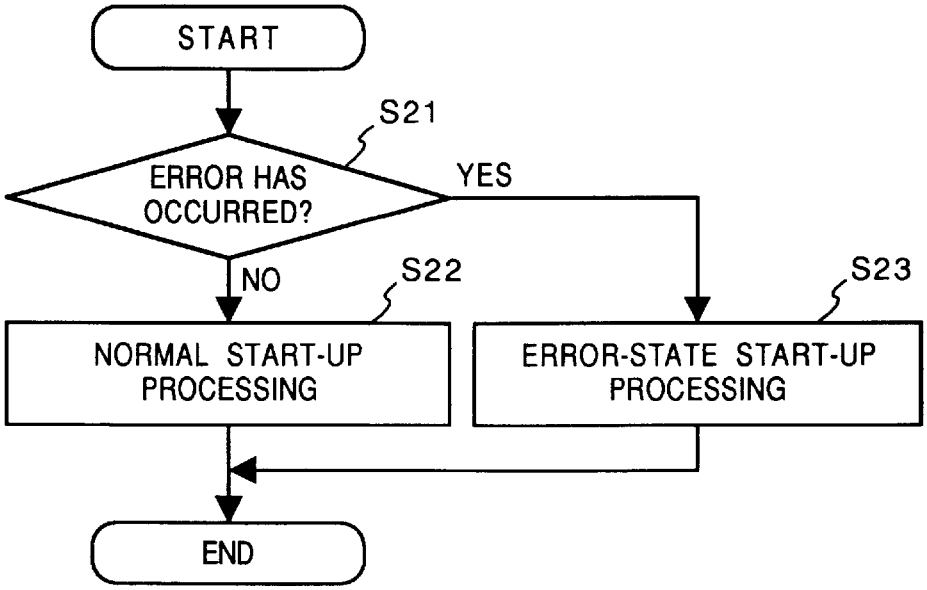
FIG. 7 is a flowchart showing power control operation by the power controller upon turning on of an LBP according to the first embodiment.

FIG. 6 shows the operation procedure by the power controller 7. The power controller 7 receives the error information and controls the power 8 with the procedure as shown in FIG. 6.

In step S11, whether the error information 40 from the error processor 6 was received or not is determined. If YES, the process proceeds to step S12. In steps S12 to S14, whether an error-removal operation has been executed within a predetermined period or not is determined. In step S12, time measurement is started, and in step S13, whether the error-removal operation has been executed or not is determined. If YES in step S13, that means the execution of error-removal operation within the predetermined period. In this case, the process ends. On the other hand, if NO, the process returns to step S13, to repeat the above operation. If it is determined that the predetermined time has elapsed in step S14, that means the error-removal operation has not been executed within the predetermined period, the process proceeds to step S15.

It should be noted that the determination as to whether an error-removal operation has been executed or not may be made by, e.g., detecting whether or not the operator has manipulated a particular switch on the operation panel 101, or detecting, using a micro switch or the like, whether or not a printer cover is opened. Note that in a case where a safety device that turns off a high-voltage portion upon detection of opening the cover is provided, this device may be utilized for the purpose of determining the execution of error-removal operation.

In step S15, the error information 40 is stored in the storage device 11. In step S16, instruction to stop the power supply (hereinafter referred to as "power-off instruction") is outputted to the power 8, thus, the power supply is shut off.

Next, the operation of the power controller 7, in a case where the power is turned off in the above manner and the user turns on the power, will be described with reference to the flowchart in FIG. 7. FIG. 7 shows the procedure when the power of the LBP 100 is turned on.

When the power is turned on, in step S21, the error information 40 stored in the storage device 1 is read out, and the error flag 41 is checked to determine whether or not the power was turned off due to an error state without error-removal operation for the predetermined period. If NO, i.e., it is determined that the power was turned off by normal turn-off operation, the process proceeds to step S22, in which normal start-up processing is performed. If YES, i.e., it is determined that the power was turned off because of an error state without erro-removal operation for the predetermined period, the process proceeds to step S23, in which the LBP 100 is started up in the error state based on the error type 42 of the error information 40.

As described above, according to the first embodiment, in a case where an error occurs and the error state is not found for a predetermined period, the power supply to the respective elements of the printer is automatically shut off. This prevents wasteful electricity consumption.

Second Embodiment

In the first embodiment, the power controller 7 stores the error flag 41 and the error type 42 of the error information 40 into the storage device 11 and shut off the power supply to the printer. Accordingly, printing data being processed at that time disappears. In case of serious error state, e.g., a fault in a motor which requires a long time for fixing, it is not necessary to take the deletion of printing data into account. However, in case of minor error state such as paper jam, it is desirable that the current printing resumes after error-removal operation by the user.

Figure 8:
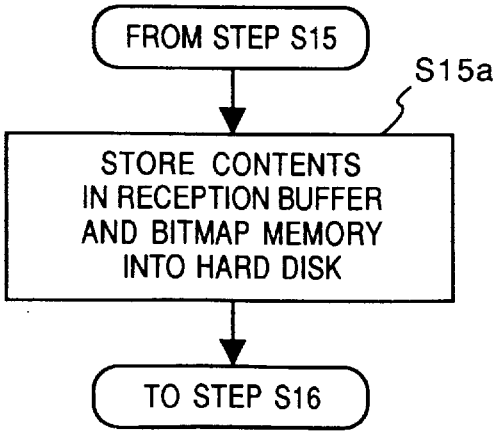
FIG. 8 is a flowchart showing a part of operation by a power controller according to a second embodiment.

In the second embodiment, the storage device 11 comprises a hard disk for storing the printing data. FIG. 8 shows the operation characteristic to the second embodiment. In accordance with this operation, after step S15 in the first embodiment (FIG. 6), the error information 40 is stored into the storage device 11, thereafter, the process advances to step S15*a* in FIG. 8. In step S15*a*, the printing data stored in the reception buffer 24*a* and the image data in the bitmap memory 24*b* are stored into the storage device 11. Then, the process advances to step S16 in FIG. 6, to output the power-off instruction to the power 8. The power 8 turns off the power of the printer.

Figure 9:
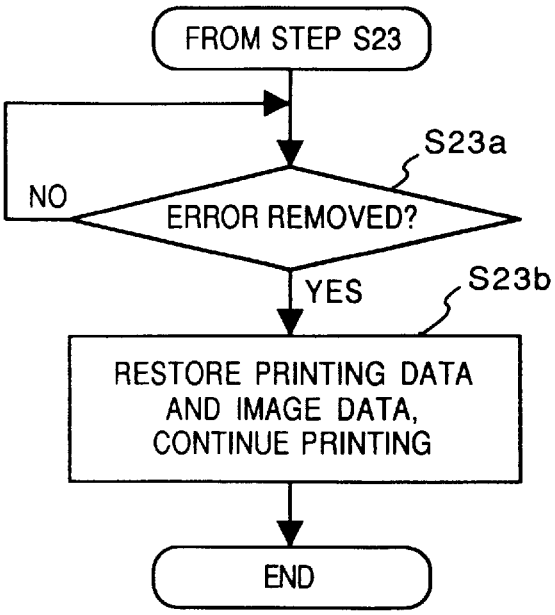
FIG. 9 is a flowchart showing a part of operation by the power controller upon turning on of a LBP according to the second embodiment.

Next, the operation characteristic to the second embodiment upon turning on the power will be described with reference to the flowchart in FIG. 9. When the power is turned on in an error state, the controller reads the error information 40 out of the storage device 11, and starts remained in the error state (steps S21 and S23 in FIG. 7). The process advances to step S23*a* in FIG. 9, in which error-removal operation is made, then proceeds to step S23*b*, in which the printing data and the image data stored in the hard disk of the storage device 11 is read out and then respectively stored into the reception buffer 24*a* and the bitmap memory 24*b*, thereafter, the printer resumes the printing operation. It should be noted that the storage for the printing data is not limited to a hard disk. Any non-volatile storage that maintains data inspite of turning off of the power is applicable.

As described above, according to the first and second embodiments, if any operation has not been made for a predetermined period after the occurrence of error to the printer, the power of the printer is automatically turned off to reduce wasteful electricity consumption. Further, when the power is automatically turned off, the error state is maintained after the power is turned on again. This allows the operator to make appropriate operation.

According to the second embodiment, as printing data in the reception buffer 24*a* and image data in the bitmap memory 24*b* are stored into the hard disk of the storage device 11 when the power is shut off, even when the error state is removed after the power has been turned on, the printing at the shut-off time can be resumed using the maintained data in the hard disk. This improves operability.

It should be noted that the first and second embodiments control shutting off the power based on whether or not any error-removal operation has been made within a predetermined period from the error-occurrence point, however, this does not pose any limitation upon the present invention. For example, the shut-off control may be performed based on whether or not the error state has been removed within a predetermined period from the error-occurrence point.

Third Embodiment

In the first and second embodiments, the printer automatically shuts off the power in a case where it detects an error state. In the third embodiment, a printer, which shuts off its power when the power of an external device such as a host computer is off, will be described. Note that the construction of an LBP and that of the control system are identical to those of the first embodiment shown in FIGS. 1 and 2, therefore, the explanations of the constructions will be omitted. Further, in this embodiment, the storage device 11 in FIG. 2 may be omitted.

Figure 10:
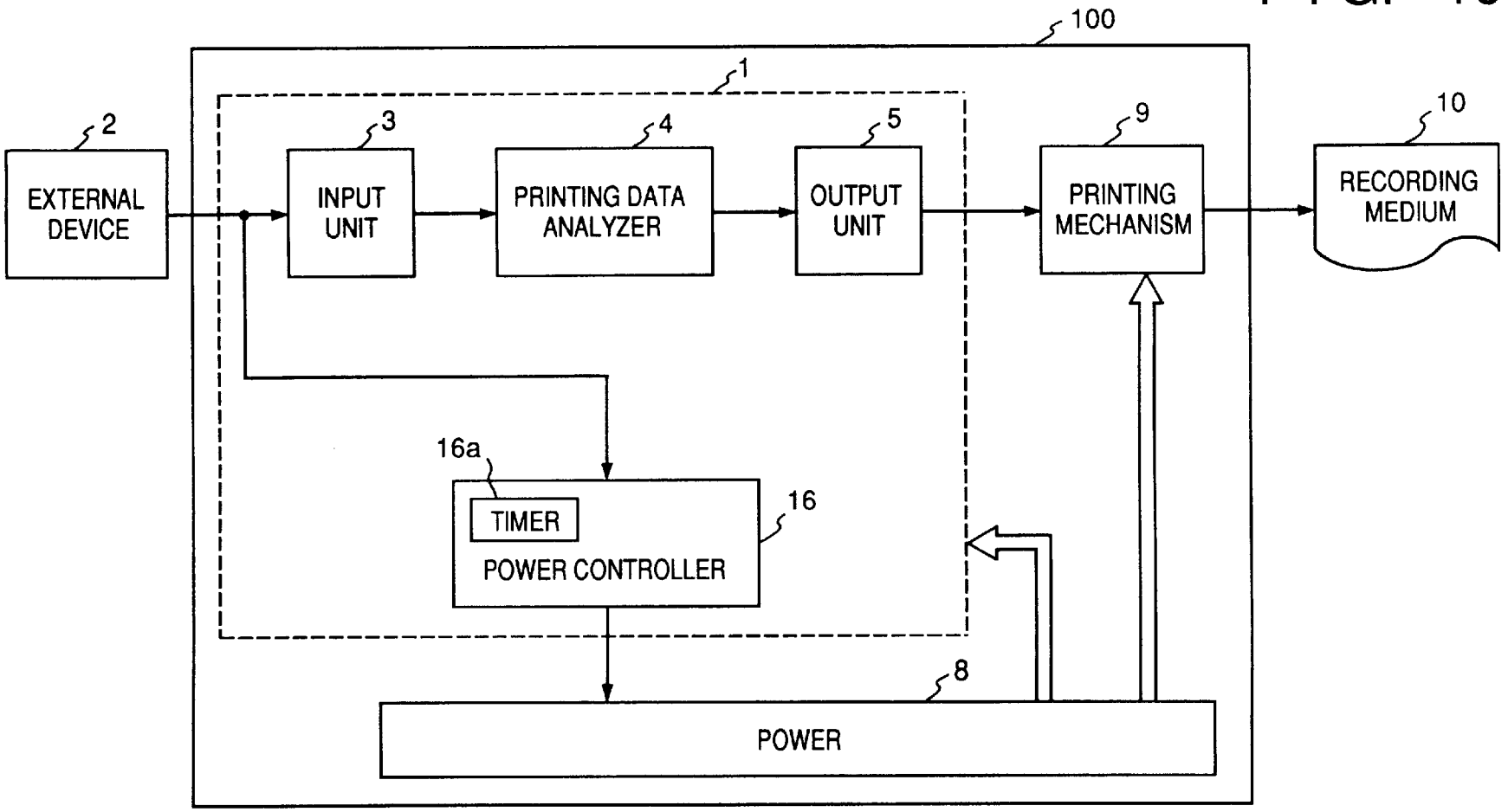
FIG. 10 is a block diagram showing the construction of a controller according to a third embodiment.

FIG. 10 shows the construction of the controller according to the third embodiment. In FIG. 10, elements corresponding to those in FIG. 3 have the same reference numerals. Further, the operation in a normal printing state is similar to that in the first embodiment, therefore, the explanation of the operation will be omitted. In FIG. 10, a power controller 16 monitors the on/off state of the power of the external device 2. If the power is off for a predetermined period, the power controller 16 outputs a power-off instruction to the power 8 to stop the power supply to the respective elements of the LBP 100.

The external device 2 and the input unit 3 are usually connected via an interface cable. The power controller 16 monitors a signal indicative of on/off state of the power of the device 2 or a substitute signal, i.e., the "on/off signal" of pin #18 in a centronics interface if used for connecting the device 2 and the LBP 100.

The power controller 16 includes a timer 16*a* for measuring time. If the power of the external device 2 is off for a predetermined period, the power controller 16 outputs an instruction to turn the power of the LBP 100 off (power-off instruction) to the power 8. As the power 8 receives the power-off instruction from the power controller 16, it shuts off the power supply to the respective elements of the LBP 100.

Figure 11:
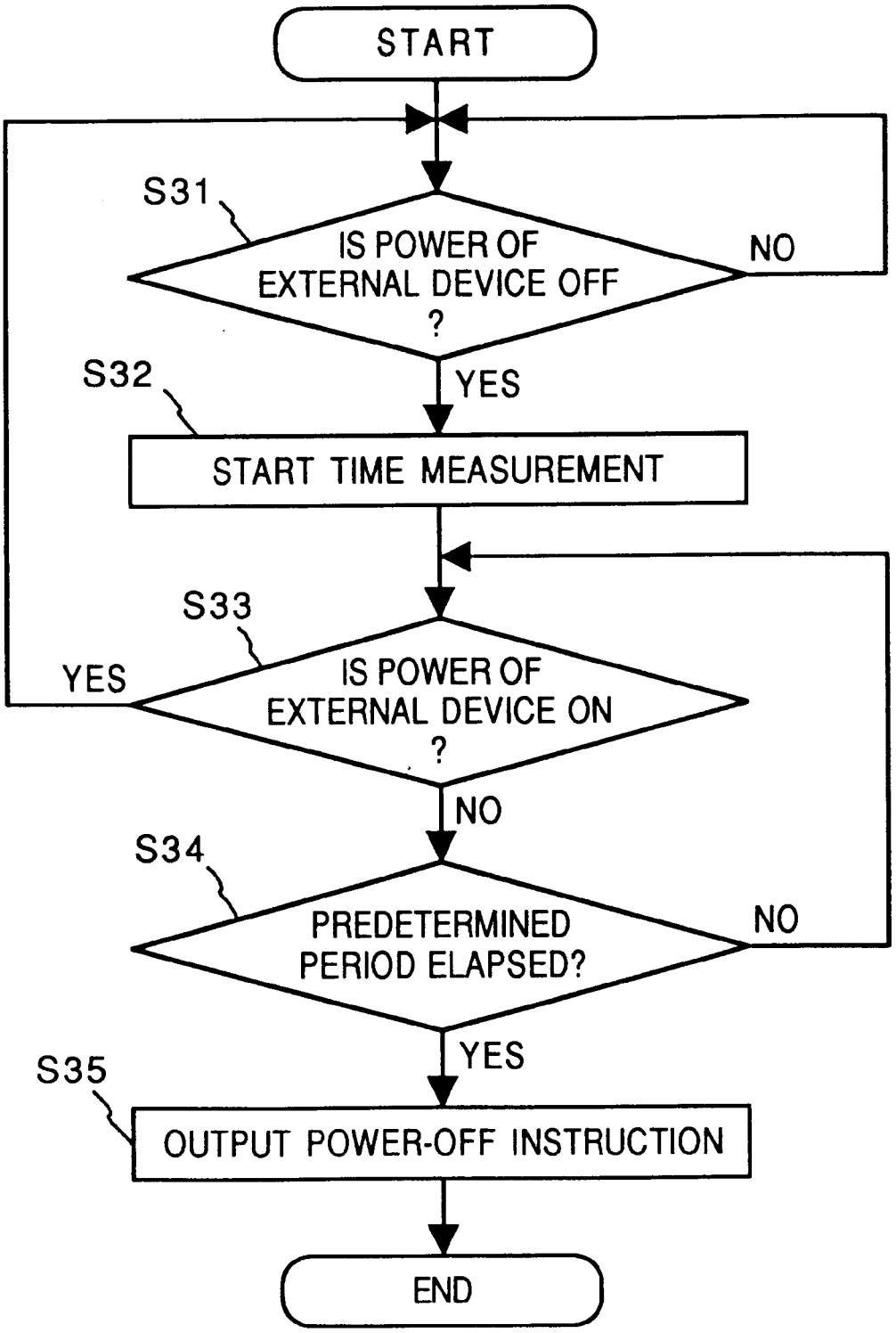
FIG. 11 is a flowchart showing power control operation used by a power controller 16 according to the third embodiment.

FIG. 11 shows power control processing by the power controller 16. In step S31, whether the power of the external device 2 is on or off is monitored. If the power is off, the timer 16*a* starts measuring time in step S32. In steps S33 and S34, whether or not the off-state of the power has continued for a predetermined period is determined.

In step S33, whether the power of the external device 2 is on or not is determined. If YES, it means that the off-state has not continued for the predetermined period. Then, the process returns to step S31. On the other hand, if NO, the process proceeds to step S34, in which whether the predetermined period has elapsed since the time measurement was started in step S32 or not is determined. If NO, the process returns to step S33. If YES, it means that the off-state has continued for the predetermined period, then the process proceeds to step S35. In step S35, a power-off instruction is outputted to the power 8, to shut off the power supply to the LBP 100.

Fourth Embodiment

In the third embodiment, when the power controller 16 outputs a power-off instruction to the power 8, the power supply to the LBP 100 is automatically shut off. Accordingly, the user has to turn on the power switch of the LBP for next use. In the fourth embodiment, the LBP 100 power is automatically turned on by turning on the power of the external device 2.

The procedure of the fourth embodiment will be described below with reference to the block diagram of FIG. 10. Note that the power 8 according to this embodiment separately shuts off power supply to the controller 1 and power supply to the printing mechanism 9. When the power 8 receives the power-off instruction from the power controller 16, by the processing as shown in FIG. 11, it only shuts off the power supply to the printing mechanism 9 and maintains the power supply to the controller 1. In this state, the power controller 16 continues to monitor the on/off state of the power of the external device 2. When the state of the power becomes on, the power controller 16 outputs a "power-on" instruction to the power 8. The power 8 restarts the power supply to the printing mechanism 9.

Figure 12:
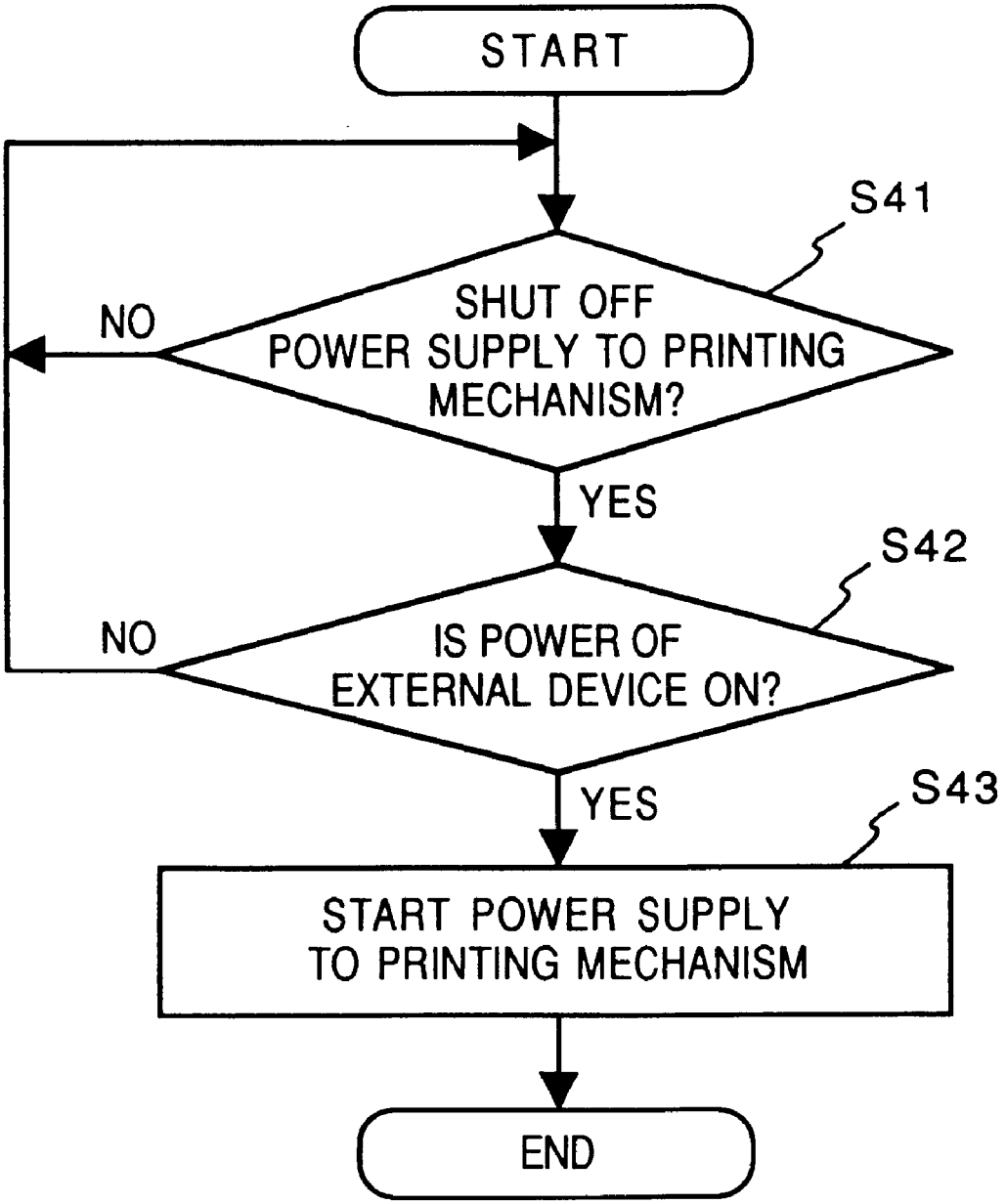
FIG. 12 is a flowchart showing power control operation used by a power controller according to a fourth embodiment.

FIG. 12 shows the procedure by the power controller 16 for restarting the power supply to the printing mechanism 9. In step S41, whether the power supply to the printing mechanism 9 is shut off or not is determined. If YES, and if the power of the external device 2 is on in step S42, the process proceeds to step S43, in which the power supply to the printing mechanism 9 is restarted.

As described above, when the power of the external device 2 is turned on, the LBP automatically becomes in a printing-standby state. In this case, the controller 1 is always powered, however, compared with the electricity consumption in the printing mechanism 9, the electricity consumption amount in the controller 1 is negligibly small. Accordingly, shutting off the power supply to the printing mechanism 9 while the power of the external device 2 is off is very useful from the viewpoint of energy saving.

In this embodiment, the power of the LBP is automatically turned off based on the off-state of the power of the external device 2 for the predetermined period. This period may be set by a user. In this case, if the user sets the period to a comparatively long time (e.g., thirty minutes), this function provides a system which automatically turns off the power of the LBP 100 when it determines that the user has forgotten to turn off the power. Further, setting the period to a short time allows the power supply to the LBP 100 to interact with turning on/off the power of the external device 2.

As described above, according to the third and fourth embodiments, if the power of the external device 2 is off and a state where data transfer is not performed for a predetermined period, the power of the LBP 100 is automatically turned off. This reduces wasteful electricity consumption.

Further, the third and fourth embodiments employ a part of a signal in a data transmission interface for judging the state of the external device 2. This does not need additional hardware construction, and provides a lower-priced apparatus.

In the third and fourth embodiments, the power controller 16 outputs a power-off instruction to the power 8 if the off-state of the power of the external device continues for a predetermined period. However, this does not pose any limitation upon the present invention. Combining other conditions can be utilized for outputting the power-off instruction. For example, if two conditions are satisfied, i.e., the off-state of the power of the external device 2 has continued for a predetermined period and the LBP 100 has not been operated for a predetermined period, the power controller 16 may output a power-off instruction. This is realized by inserting a condition "Is the power of external device on, or any access to LBP has been made?" into step S33 in the flowchart of FIG. 11.

Further, the third and fourth embodiments control the power supply to the printer based on the off-state of the power of the external device, however, the condition of the power-supply control is not limited to this off-state of the external device. For example, disconnection between the external device and the printer may be utilized as a condition for the power-supply shut-off control.

Moreover, though the third and fourth embodiments use a signal line of an interface cable for judging the state of the power (on/off) of the external device 2, this does not pose any limitation upon the present invention.

Fifth Embodiment

The first to fourth embodiments control the power supply to the printer based on a state of the printer and that of an external device and thus save electricity consumption. The fifth embodiment saves electricity by controlling the display state of the display. It should be noted that the printer according to the fifth embodiment has a construction identical to that of the first embodiment shown in FIG. 1, therefore, the explanation of the construction will be omitted.

[Printer Control System (FIG. 13)]

Figure 13:
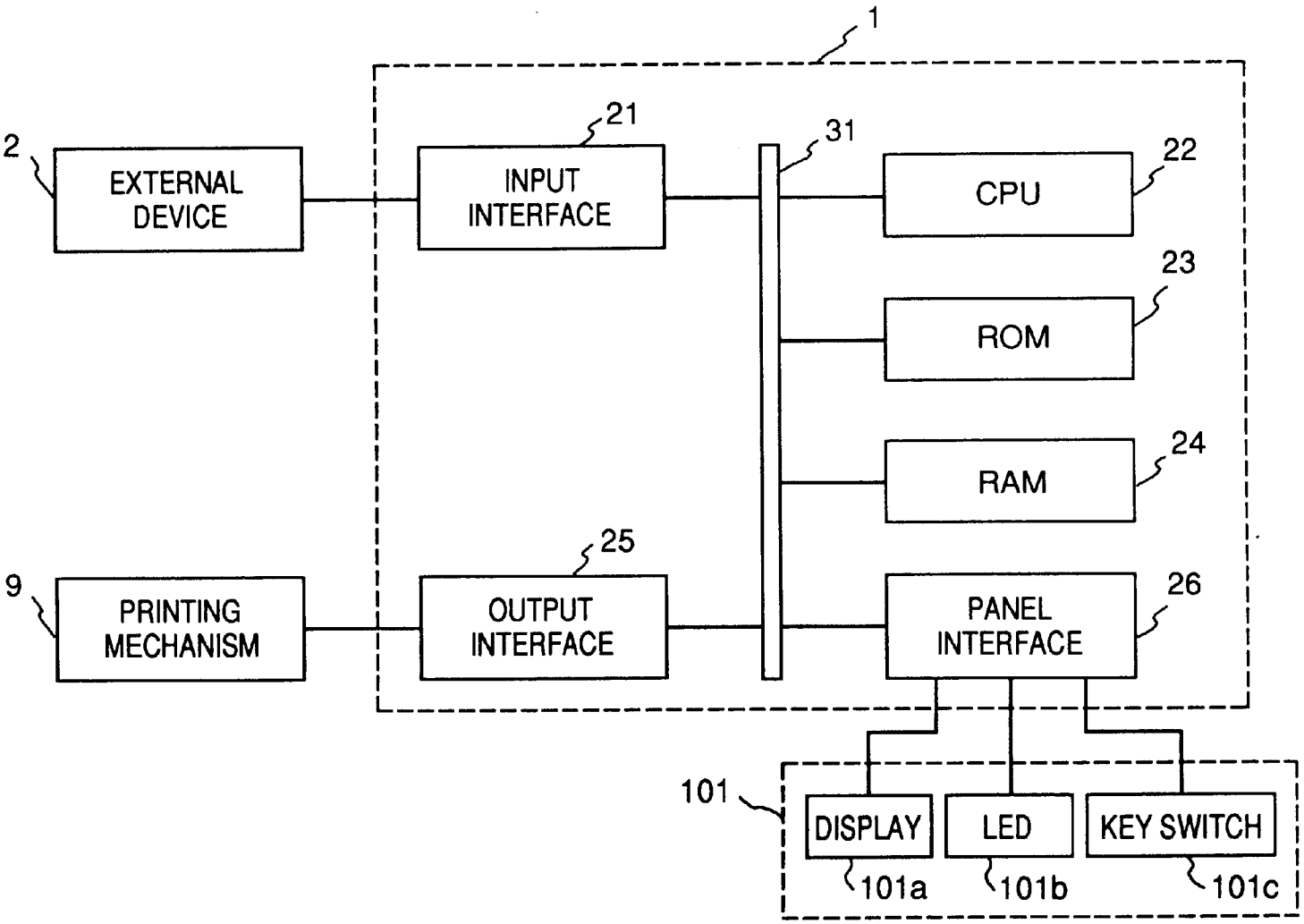
FIG. 13 is a block diagram showing the construction of a controller of a printing apparatus according to a fifth embodiment.

FIG. 13 shows the construction of the control system of the laser-beam printer (LBP) according to the fifth embodiment. In FIG. 13, elements corresponding to those in the first embodiment (FIG. 2) have the same reference numerals and the explanations of the elements will be omitted.

Numeral 26 denotes a panel interface for input/output of the operation panel 101. The operation panel 101 has a display 101*a*, an LED 101*b*, and a switch 101*c* for input operation. The panel interface 26 is also connected to the system bus 31.

Figure 14:
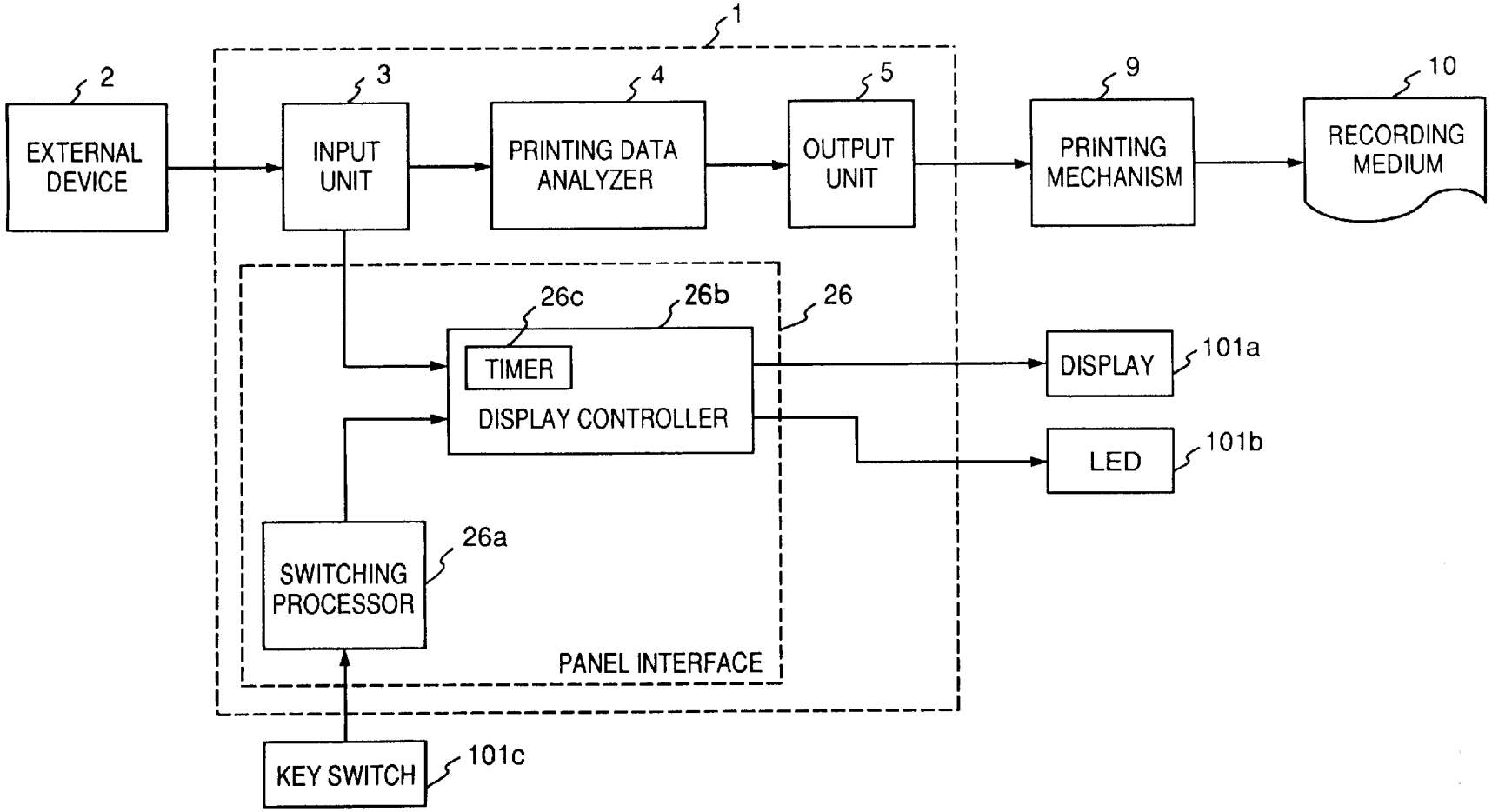
FIG. 14 is a block diagram showing the construction of the controller according to the fifth embodiment.

The operation of the printer according to the fifth embodiment having the above construction will be described below. FIG. 14 shows the control functions realized by the controller 1. Numeral 2 denotes an external device such as a host computer, for outputting printing data; 3, an input unit for receiving the data; 4, a printing data analyzer for analyzing the input data and generating a bitmapped output image; 5, an output unit for turning on and off the laser beam based on the output image; 9, a printing mechanism for printing; and 10, a recording medium such as a recording sheet. Further, numeral 26*a* denotes a switching processor for discriminating operation at the key switch 101*c* and processing the operation; 26*b*, a display controller for controlling the display 101*a* and the LED 101*b* based on information from a switching processor 26*a*; and 26*c*, a timer having a time-measuring function.

[Control Procedure]

Figure 15:
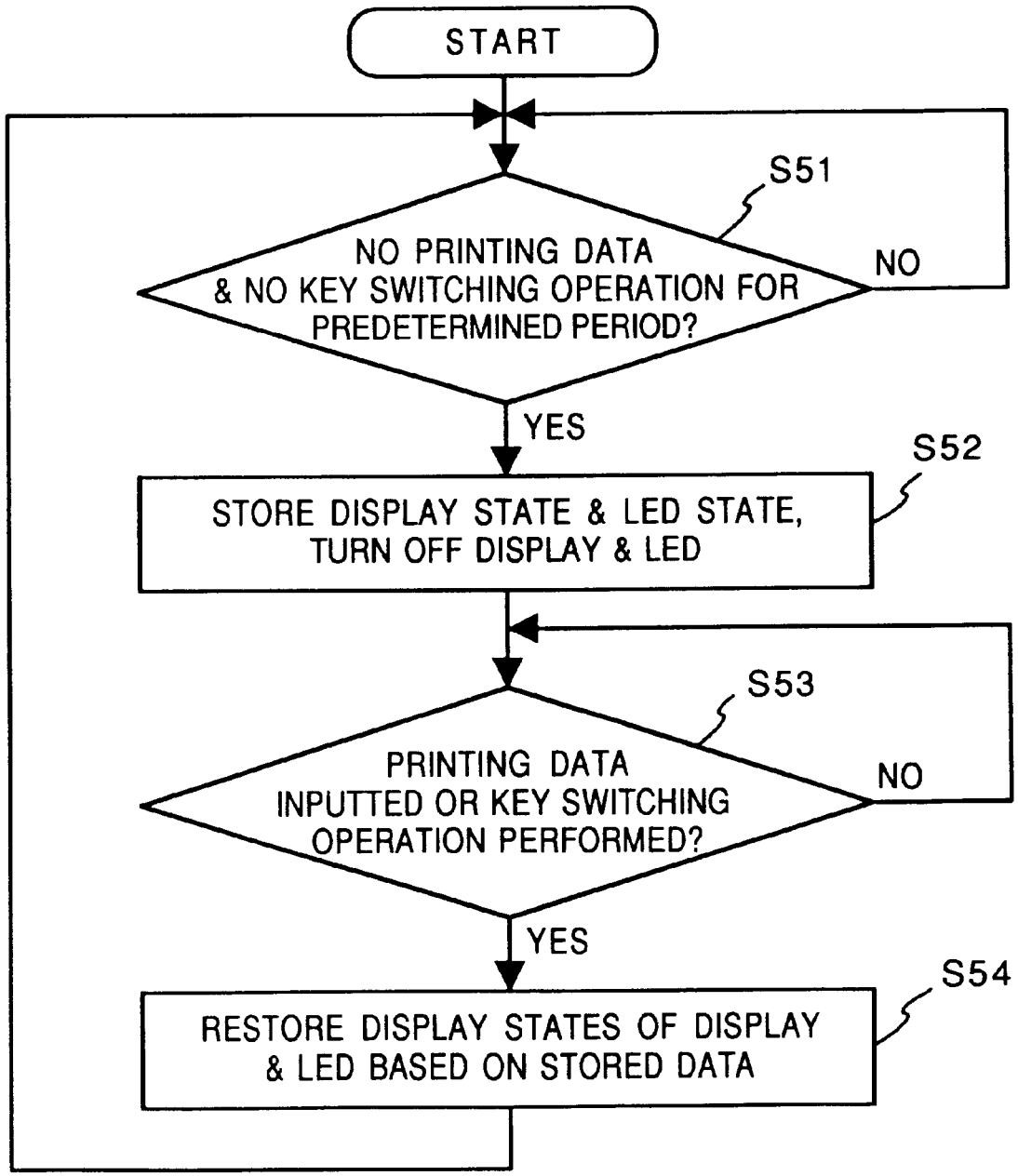
FIG. 15 is a flowchart showing a display control according to the fifth embodiment.

FIG. 15 shows the display control by the display controller 26*b*. This procedure is realized by executing programs in the ROM 23 by the CPU 22 in FIG. 13.

In FIG. 15, when the power of the printer is turned on and the printer becomes ready for printing, the display controller 26*b* starts immediately.

In step S51, the input unit 3 and the switching processor 26*a* are always monitored to determine whether or not a state where no printing data is inputted and no switching operation is made has continued for a predetermined period.

If YES, a current display state of the display 101*a* and that of the LED 101*b* are stored into the RAM 24 (FIG. 3) of the printer, and the display 101*a* and the LED 101*b* are turned off in step S52.

In step S53, inputting of printing data or key-switching operation is awaited.

If printing data is inputted or switching operation is made in step S53, the data in the RAM 24 is read out in step S54, and the display states of the display 101*a* and the LED 101*b* are restored based on the read data. Then the process returns to step S51.

In this manner, the printer turns off the display 101*a* and the LED 101*b* if it has not received printing data for a predetermined period. This saves electricity consumption. In this state, when printing data is inputted, the printer restores the display states before the turning-off operation.

According to the fifth embodiment, if no printing data is inputted to the printer, and no switching operation is made for a predetermined period, the display and the LED are turned off. However, the brightness of the display and the LED may be merely lowered by reducing the power supply. Even if the display and the LED are turned off, they may be turned on and off at predetermined intervals, to inform the user that the power is still on. Otherwise, a particular display may be turned on while the other displays may be turned off.

These operations are useful to save electricity consumption and to notify the user of the on-state of the power.

It should be noted that the above embodiments employ a laser-beam printer as a printing apparatus, however, the printer is not limited to the laser-beam printer, and other printers, e.g., an ink-jet printer to be described below can be used.

[Outline of Ink-Jet Printer]

Figure 16:
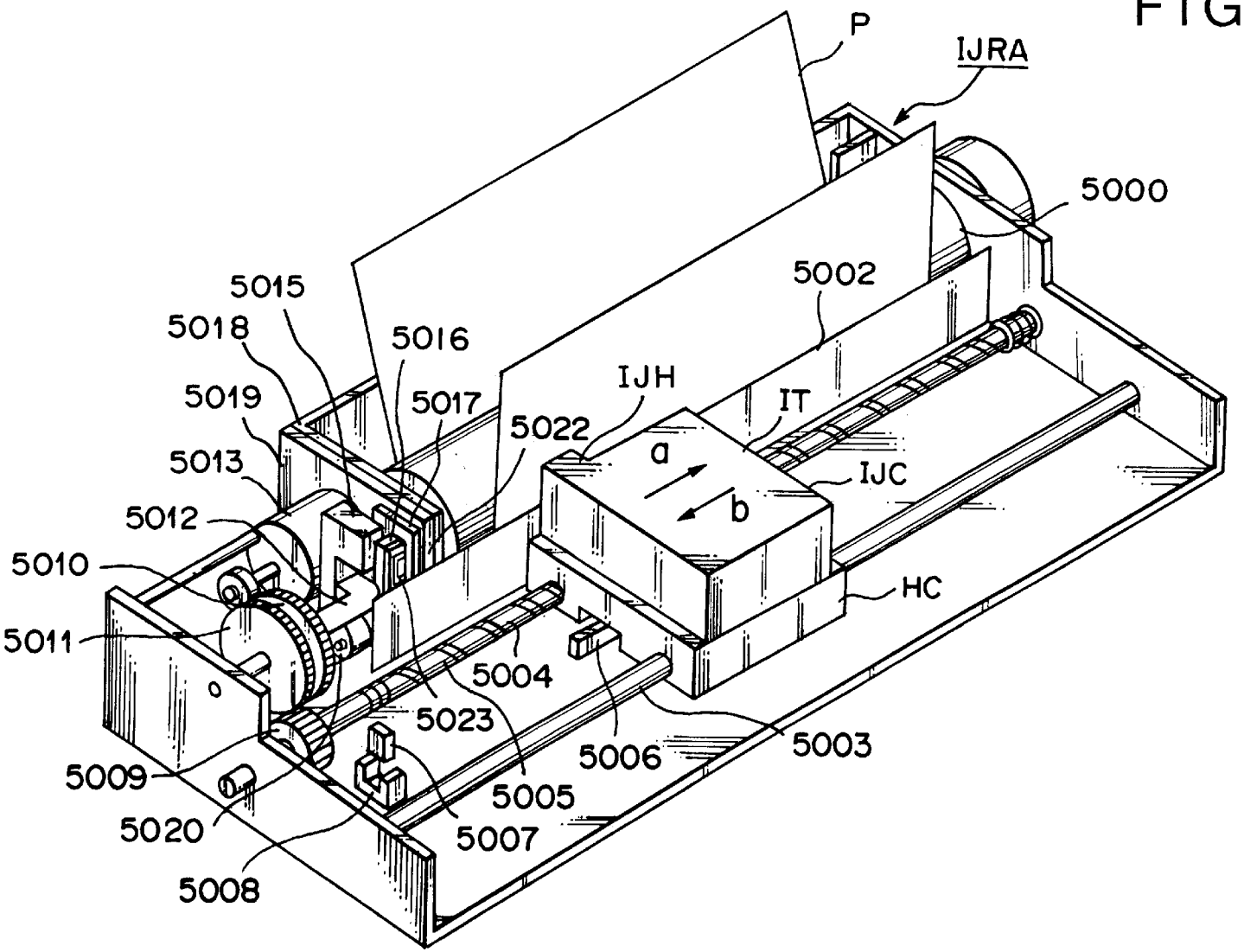

FIG. 16 shows the structure of ink-jet recording apparatus IJRA to which the present invention is applied. In FIG. 16, carriage HC is engaged with spiral groove 5004 of lead screw 5005 which rotates via driving force transmission gears 5011 and 5009 interlocking with forward/reverse rotation of driving motor 5013. The carriage has a pin (not shown) and it is reciprocally moved in directions represented by arrows a and b. The carriage HC has ink-jet cartridge IJC. Paper bail 5002 presses a recording sheet against platen 5000 along the moving direction of the carriage. Photocouplers 5007 and 5008 are home position detecting members for confirming the existence of lever 5006 of the carriage in this area and changing over the rotational direction of motor 5013. Support member 5016 supports cap member 5022 for capping the front surface of the printing head. Suction member 5015 performs suction-restoration of the printing head the inside of the cap member 5022 via cap inner opening 5023. Member 5019 allows cleaning blade 5017 to move in a back-and-forth direction. Main body support plate 5018 supports the member 5019 and the cleaning blade 5017. It is apparent that any publicly-known cleaning blade is applicable to the printer of the embodiments. Numeral 5021 denotes a lever for starting the sucking operation of the suction-restoration. The lever 5021 moves along the movement of cam 5020 engaged with the carriage. A publicly-known transmission means such as change-over of a clutch controls a driving force from the driving motor.

When the carriage arrives at the home position, a desired processing among the capping, cleaning and suction-restoration is executed at its corresponding position by the lead screw 5005. Any of these processings is applicable to the printer of the embodiments, if a desired processing is performed at a publicly-known timing.

[Control System of Ink-Jet Printer]

Figure 17:
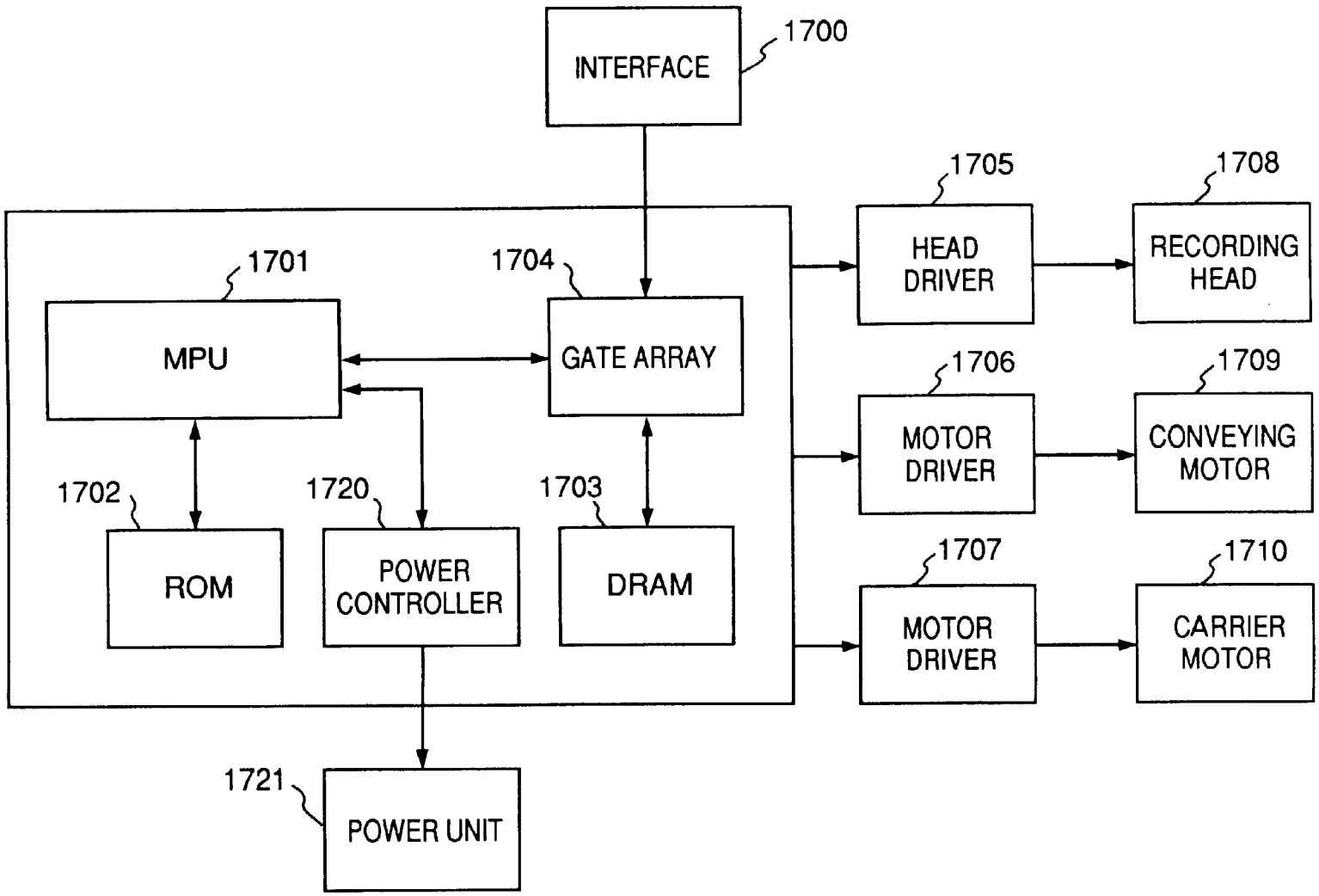
FIGS. 17 and 18 are block diagrams showing the construction of a controller for executing recording control of the ink-jet recording apparatus.

Next, the control system configuration for controlling the recording by the above recording apparatus will be described with reference to a block diagram of FIG. 17 showing a control circuit. In FIG. 17, reference numeral 1700 denotes an interface for inputting a recording signal; 1701, a MPU; 1702, a program ROM for storing control programs performed by the MPU 1701; 1703, a dynamic RAM for storing various data (the recording signal, recording data to be supplied to recording head 1708, etc.); 1704, a gate array for supplying the recording data to the recording head 1708, and for controlling data transfer among the interface 1700, the MPU 1701 and the DRAM 1703; 1710, a carrier motor for carrying the recording head 1708; 1709, a conveying motor for conveying a recording sheet; 1705, a head driver for driving the head 1708; and 1706 and 1707, motor drivers for respectively driving the conveying motor 1709 and the carrier motor 1710.

In the above construction, when a recording signal enters the interface 1700, the signal is converted into recording data for printing between the gate array 1704 and the MPU 1701. The motor drivers 1706 and 1707 are activated, and the recording head is driven in accordance with the recording data transferred to the head driver 1705, thus printing is performed.

In FIG. 17, a power controller 1720 determines an abnormal state or a predetermined period of incommunicable state with the external device, and outputting an instruction to shut off the power supply to the printer. A power unit 1721 shuts off the power supply to the printer. The MPU 1701 executes the control represented by the flowcharts in the first to fourth embodiments. Thus, it is apparent that the present invention can be applied to an ink-jet printer.

Figure 18:
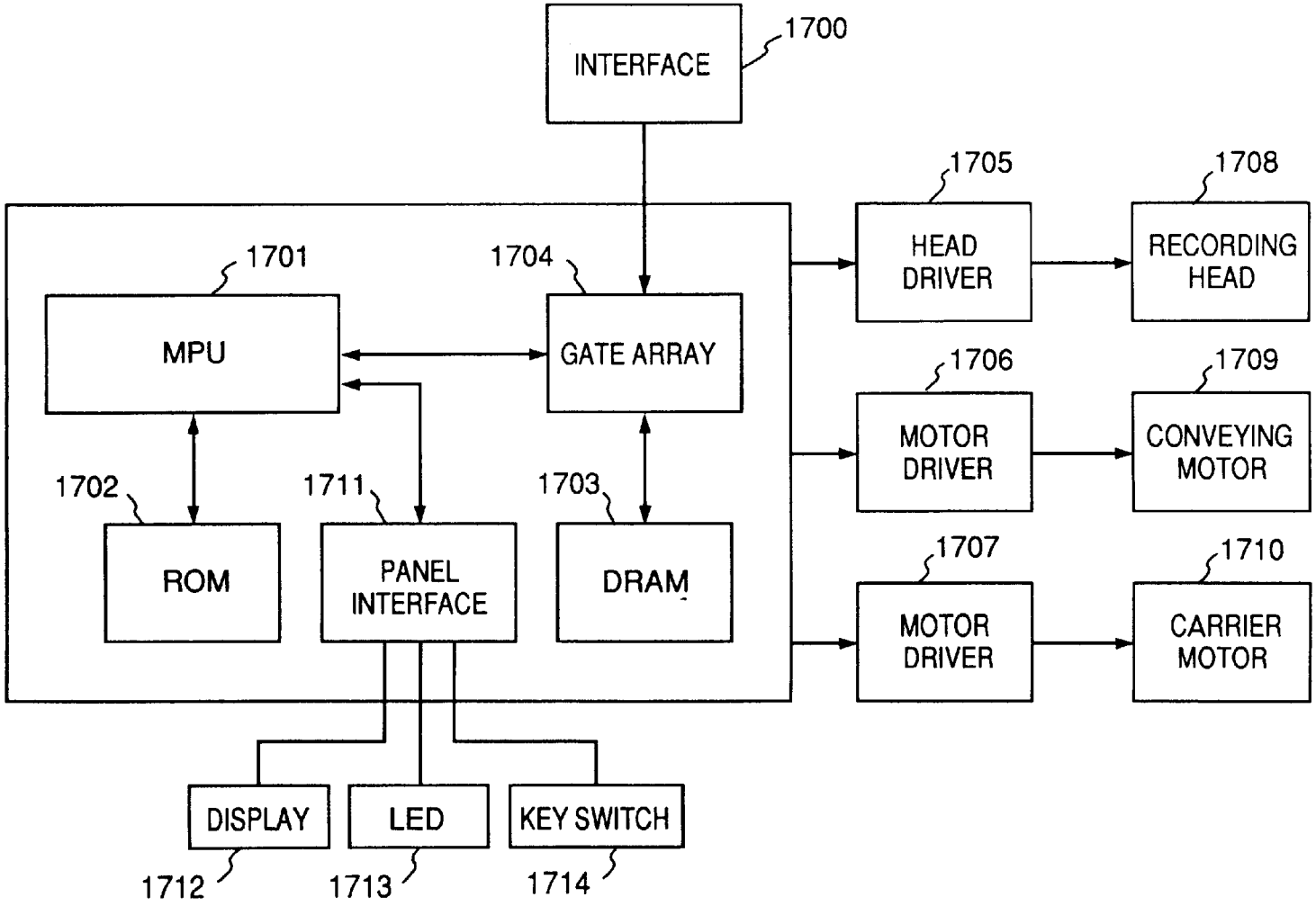

In FIG. 18, numeral 1711 denotes an interface for the operation panel of the printer; 1712, a display; 1713, an LED for displaying a printer state; and 1714, a key switch for inputting by an operator. Note that FIG. does not show these elements.

Further, the MPU 1701 controls the display states of the LED 1713 and the display 1712 in accordance with the procedure of the fifth embodiment shown in FIG. 15.

As described above, the present invention can be applied to an ink-jet printer control system as well as an LBP control system.

Further, the peripheral device control method according to the present invention can be applied to any other peripheral devices connected to a host computer or the like, as well as a printing apparatus.

Moreover, the above embodiments can be combined arbitrarily.

The present invention can be applied to a system constituted by a plurality of devices, or to an apparatus comprising a single device. Furthermore, it goes without saying that the invention is applicable also to a case where the object of the invention is attained by supplying a program to a system or apparatus.

As described above, according to the present invention, if a state where the power supply to a peripheral device is useless continues for a predetermined period, the power supply to the device is turned off. Thus prevention of wasteful electricity consumption can be attained.

As described above, the printing apparatus and its control method according to the present invention can save electricity.

The present invention is not limited to the above embodiments and various changes and modifications can be made within the spirit and scope of the present invention. Therefore, to apprise the public of the scope of the present invention, the following claims are made.

What is claimed is:

1. A printing apparatus for inputting printing data from an external device and performing recording on a recording medium based on the printing data, comprising:

detection means for detecting an abnormal state of said apparatus;

generation means for generating abnormality information based on the abnormal state detected by said detection means;

determination means for determining that the abnormal state detected by said detection means has continued for a predetermined period;

shut-off means for storing the abnormality information into a storage and shutting off the power supply to said printing apparatus; and start-up means for, when said printing apparatus is turned on, changing a normal start-up procedure of said printing apparatus to a different start-up procedure selected based on the abnormality information stored in the storage and starting up said printing apparatus in the different start-up procedure.

2. The printing apparatus according to claim 1, wherein said start-up means, in the different start-up procedure, displays a content of the abnormal state based on the abnormality information stored in the storage.

3. The printing apparatus according to claim 1, wherein said shut-off means stores recording data on the recording, with the abnormality information, into the storage, and shuts off the power supply to said printing apparatus, and wherein if the abnormality information is stored in the storage when said printing apparatus is turned on, said start-up means restores the recording data from the storage.

4. A printing apparatus for performing recording based on input data from an external device, comprising:

display means for displaying various states;

determination means for determining that at least one of a plurality of states has continued for a predetermined period, the plurality of states including a state in which said printing apparatus receives no input data from the external device, a state in which said printing apparatus has no key input and a state in which no releasing operation has been made after an occurrence of error in said printing apparatus; and control means for controlling said display means such that a power supplied to said display means is reduced and so that said display means provides an indication to a user that said printing apparatus is operating in a power saving mode, based on a determination result provided by said determination means.

5. The printing apparatus according to claim 4, wherein said control means lowers brightness of the display of said display means based on the determination result by said determination means.

6. The printing apparatus according to claim 4, wherein said control means turns off display of said display means except a predetermined part of the display, based on the determination result by said determination means.

7. The printing apparatus according to claim 4, wherein said control means turns on and off the display of said display means at predetermined intervals, based on the determination result by said determination means.

8. A control method for a printing apparatus for performing processing based on input data from an external device, comprising:

a detection step of detecting an abnormal state of the apparatus;

a generation step of generating abnormality information based on the abnormal state detected in said detection step;

a determination step of determining that the abnormal state detected in said detection step has continued for a predetermined period;

a shut-off step of storing the abnormality information into a storage and shutting off power supply to the printing apparatus; and a start-up step of, when said printing apparatus is turned on, changing a start-up procedure of the printing apparatus to a different start-up procedure selected based on the abnormality information stored in the storage and starting up the printing apparatus in the different start-up procedure.

9. The method according to claim 8, wherein said start-up step, in the different start-up procedure, displays a content of the abnormal state based on the abnormality information stored in the storage.

10. The method according to claim 8, wherein in said shut-off step, recording data on the recording with the abnormality information are stored into the storage, and the power supply to said printing apparatus is shut off, and wherein in said start-up step, if the abnormality information is stored in the storage when said printing apparatus is turned on, the recording data is restored from the storage.

11. A control method for a printing apparatus for performing processing based on input data from an external device and displaying various states with a display unit, comprising:

a determination step of determining that at least one of a plurality of states has continued for a predetermined period, the plurality of states including a state in which the printing apparatus receives no input data from the external device, a state in which the printing apparatus has no key input and a state in which no releasing operation has been made after an occurrence of error in the printing apparatus; and a control step of controlling the display unit such that a power supplied to the display unit is reduced and so that the display means provides an indication to a user that the printing apparatus is operating in a power saving mode, based on a determination result in said determination step.

12. The method according to claim 11, wherein in said control step, brightness of the display of the display unit is lowered based on the determination result in said determination step.

13. The printing apparatus according to claim 11, wherein in said control step, display of the display unit is turned off except a predetermined part of the display, based on the determination result in said determination step.

14. The printing apparatus according to claim 11, wherein in said control step, the display of the display unit is turned on and off at predetermined intervals, based on the determination result in said determination step.

* * * * *

UNITED STATES PATENT AND TRADEMARK OFFICE

CERTIFICATE OF CORRECTION

PATENT NO. : 5,897,252

DATED : April 27, 1999

INVENTOR(S) : YUKIO KANAKUBO

It is certified that error appears in the above-identified patent and that said Letters Patent is hereby corrected as shown below:

COLUMN 6

Line 59, "erro-removal" should read --error-removal--.

COLUMN 12

Line 22, "FIG." should read --FIG. 5--.

COLUMN 14

Line 49, "printing apparatus" should read --method--; and
Line 53, "printing apparatus" should read --method--.

Signed and Sealed this
First Day of February, 2000

*Attest:*

*Attesting Officer*

Q. TODD DICKINSON

*Acting Commissioner of Patents and Trademarks*